US005274960A

United States Patent [19]

Karlsrud

[11] Patent Number: 5,274,960

[45] Date of Patent: Jan. 4, 1994

[54] UNIFORM VELOCITY DOUBLE SIDED FINISHING MACHINE

[75] Inventor: Chris E. Karlsrud, Chandler, Ariz.

[73] Assignee: Speedfam Corporation, Chandler, Ariz.

[21] Appl. No.: 601,384

[22] Filed: Oct. 23, 1990

[51] Int. Cl.[5] ..... B24B 7/17

[52] U.S. Cl. ..... 51/109 R; 51/283 R; 51/267; 51/111 R

[58] Field of Search ..... 51/60, 109

[56] References Cited

U.S. PATENT DOCUMENTS

| | | | |
|---|---|---|---|
| 225,619 | 3/1880 | Lake | 51/283 |
| 2,410,752 | 11/1946 | Sells et al. | 51/283 |
| 2,423,118 | 7/1947 | Ramsay | 51/283 |
| 2,696,067 | 12/1954 | Leach | 51/109 |
| 3,050,913 | 8/1962 | Kirby | 51/283 |
| 3,176,441 | 4/1965 | Walters | 51/283 |
| 3,263,376 | 8/1966 | Walters et al. | 51/283 |
| 4,073,094 | 2/1978 | Walz | 51/283 |

*Primary Examiner*—Bruce M. Kisliuk

*Assistant Examiner*—Eileen P. Morgan

*Attorney, Agent, or Firm*—Allegretti & Witcoff, Ltd.

[57] ABSTRACT

A machine for simultaneously finishing two sides of a workpiece simultaneously, the machine having a base, an upper polishing plate, a lower polishing plate, a carrier holding one or more workpieces between the upper and lower polishing plates, a motor attached to a spindle having a first axis, which is fixedly attached to a spindle cam having a second axis such that when the spindle rotates about the first axis, the second axis of the spindle cam moves in a circular non-rotational manner circumscribing a circle having a radius defining a critical radius. The movement of the circular spindle cam causes the lower polishing plate to move in a circular non-rotational manner. The lower polishing plate is connected to one or more eccentric cams by one or more lower polishing plate linkages. The circular non-rotational movement of the lower polishing plate is transferred to the upper polishing plate by one or more eccentric cams via lower polishing plate linkages, and one or more upper polishing plate linkages.

13 Claims, 2 Drawing Sheets

UNIFORM VELOCITY DOUBLE SIDED FINISHING MACHINE

BACKGROUND OF THE INVENTION

This invention is related to a machine capable of grinding and polishing both sides of one or more workpieces simultaneously, and a method for using the machine to grind and/or polish both sides of a plurality of workpieces simultaneously.

Many materials such as silicon, metals and glass require grinding and polishing of various surfaces before the materials can be utilized as intermediate or end products. Existing grinding and polishing machines often utilize rotating discs to simultaneously polish two sides of a workpiece simultaneously. Because the polishing plates rotate, uneven velocity profiles exist throughout the process area. This can cause uneven stock removal across the workpieces which may result in finished pieces with poor flatness and surface parallelism.

Most grinding and polishing machines utilized to grind two sides of a workpiece simultaneously employ abrasives to aid in polishing and finishing various types of workpieces. Typically these abrasives are applied to the workpieces through conduits in the polishing plates. Because the polishing plates rotate, complicated rotating connections are required between the stationary abrasive source and the rotating discs to enable polishing abrasives to be supplied to both sides of the workpieces. These connections are subject to failure which ultimately reduces the efficiency of the polishing machine.

The polishing and finishing rates of most newer polishing machines may be adjustable by adjusting the RPM of the polishing plates. Typically, an increase in the revolutions per minute of the polishing plate will result in a proportional increase in the polishing rate or grind rate of the workpieces. However, the plate velocity will vary across the radius of the workpiece with the outer portion of a polishing plate traveling at a higher velocity than the inner portion of the polishing plate. This disparity in plate velocity can cause a disparity in the ability of the polishing plate to uniformly polish or grind a workpiece. The problem is essentially due to the fact that the polishing plate rotates about a fixed axis.

Present methods of grinding and polishing workpieces generally are able to produce a satisfactory product at a satisfactory production rate. However, present methods suffer from problems related directly to the construction of rotating polishing and grinding machines. These problems include difficulties in supplying polishing abrasives to the workpieces, difficulties in maintaining a constant polishing velocity across a the surface of workpiece within a batch, and difficulties in finishing both sides of a workpiece simultaneously to a uniform finish.

SUMMARY OF INVENTION

It is an object of this invention to provide a machine for grinding and polishing two sides of one or more workpieces simultaneously, the machine having a base, an upper polishing plate, a lower polishing plate, a carrier for holding one or more workpieces, a motor, a spindle having a first axis, a spindle cam attached at a fixed radius, and from one to four eccentric drive cams.

It is a further object of this invention to provide a machine for finishing two sides of one or more workpieces simultaneously such that the forces imparted on a first side of the workpiece due to the finishing essentially cancels out the forces being applied to the second or opposite side of the workpiece.

It is an additional object of this invention to provide a machine for finishing two sides of one or more workpieces simultaneously, wherein the velocities imparted by the finishing action is essentially equivalent across the entire side of a workpiece.

It is yet a further object of this invention to provide a machine for finishing two sides of one or more workpieces simultaneously in which liquid polishing abrasive is supplied to the workpieces top and bottom of the using simple conduit connections.

Accordingly, a broad embodiment of this invention is a machine for simultaneously finishing two sides of one or more workpieces, the machine comprising a base, an upper polishing plate, a lower polishing plate, a carrier for holding one or more workpieces, a motor, a spindle having a first axis, a spindle cam having a second axis and attached to the spindle at a fixed radius, and from one to four eccentric cams. The carrier of the machine is attached to the base and located between the upper and lower polishing plates. The motor is also attached to the base and rotates the spindle about the first axis. The spindle is attached to the spindle cam at a second axis. The first axis and the second axis are offset to define a critical radius. Each eccentric cam is attached to the base and includes a bottom drive wheel and a top drive wheel. Each bottom drive wheel is rotatably united with a lower polishing plate linkage. The lower polishing plate linkage unites the lower polishing plate with a bottom drive wheel. The top drive wheel of each eccentric cam is rotatably united with a top polishing plate linkage. The top polishing plate linkage unites the top polishing plate with a top drive wheel. Each eccentric cam rotates about a third axis.

In another embodiment, this invention is a machine for simultaneously finishing two sides of one or more workpieces comprising a base, a conduit containing upper polishing plate, a conduit containing lower polishing plate with a bottom dimension having a circular depression, a carrier for holding one or more workpieces, a motor, a spindle having a first axis, a circular spindle cam having a second axis, the circular spindle cam fixedly attached to the spindle, two eccentric cams, and a down pressure system. The carrier is fixedly attached to the base in a location between the upper and lower polishing plates. The motor is attached to the base and rotates the spindle about the first axis. The spindle is fixedly associated with the circular spindle cam which occupies the circular depression in the bottom dimension of the lower polishing plate. The bottom dimension of the lower polishing plate is made of a material which is capable of acting like a bearing surface. The spindle is associated with the spindle cam such that the first axis and the second axis are offset to define a critical radius. The second axis of the spindle cam circumscribes a circle having a radius defining the critical radius. Each of the two eccentric cams include a bottom cam bearing in about 180° opposition to a top cam bearing. The top and bottom cam bearings are attached to a top drive wheel and a bottom drive wheel, respectively. The top and bottom drive wheels are united by an eccentric cam shaft oriented perpendicular to the top and bottom drive wheels. Each bottom cam bearing is rotatably associated with a lower polishing plate linkage. A lower polishing plate linkage unites the lower polishing plate with a bottom cam. Each top cam bearing is rotatably united with an upper polishing plate linkage. The upper polishing plate linkage unites the upper polishing plate with a top cam bearing. The two upper polishing plate linkages are perpendicularly associated with respect to one another while the two lower polishing plate linkages are also perpendicularly associated with respect to one another. Each top and bottom cam bearing rotates about a fourth axis. The eccentric cam shaft of each eccentric cam rotates about a third axis. The third axis is separated from the fourth axis by the critical radius.

It is also an object of this invention to provide a method to simultaneously finish two sides of one or more workpieces utilizing a machine comprising a base, an upper polishing plate, a lower polishing plate with a bottom dimension having a circular depression, a carrier for holding one or more workpieces, a motor, a spindle having a first axis, a circular spindle cam having a second axis fixedly attached to the spindle at a fixed radius, and two perpendicularly oriented eccentric cams. The carrier is attached to the base such that it is located between the upper and lower polishing plates. The motor attached to the base, rotates the spindle about the first axis. The first axis and second axis are offset to define a critical radius. The circular spindle cam occupies the circular depression of the bottom dimension of the lower polishing plate. Each of the two eccentric cams include a bottom drive wheel having a bottom cam bearing and a top drive wheel having a top cam bearing, the top and bottom cam bearings in adjustable opposition to one another. The bottom drive wheel and top drive wheel are united by an eccentric cam shaft which is oriented perpendicular to the top and bottom drive wheels. Each bottom cam bearing is rotatably united with a lower polishing plate linkage. A lower polishing plate linkage unites the lower polishing plate with a bottom cam bearing. Each top cam bearing is rotatably united with an upper polishing plate linkage. An upper polishing plate linkage unites the upper polishing plate with a top cam bearing. The eccentric cam shaft rotates about a third axis. The top and bottom cam bearings each have a fourth axis about which the upper and lower polishing plate linkages rotate. The third axis is separated from each fourth axis by the critical radius. The method comprises the steps of placing one or more workpieces, each having a top and bottom dimension, into the carrier such that the bottom dimension of each workpiece contacts the lower polishing plate. The upper polishing plate is lowered into contact with the top dimension of the workpiece or workpieces. The workpiece or workpieces are finished by actuating the motor which causes the spindle to rotate about the first axis. The rotation of the spindle about the first axis causes the circular spindle cam to circumscribe a circle such that the second axis circumscribes a circle having a radius equal to the critical radius. The rotation of the circular spindle cam about the second axis causes the bottom polishing plate to move in a circular, non-rotational manner. The motion of the bottom polishing plate is transferred to each eccentric cam by each lower polishing plate linkage which causes the eccentric cam shaft of the each eccentric cam to rotate about the third axis. The rotation of the eccentric cam shaft of each eccentric cam about the third axis causes the top drive wheel to rotate. The rotation of the top drive wheel allows the top polishing plate linkage to pivot about the fourth axis of the cam bearing. The motion of each upper polishing plate linkage is transferred to the upper polishing plate causing the upper polishing plate to move in a circular, non-rotational manner. The circular, non-rotational movement of the upper and lower polishing plates are typically in adjustable opposition to one another. When the finishing step is complete the motor is stopped, the upper polishing plate is raised so that it is out of contact with the top dimension of the workpiece or workpieces. Finally, the finished workpieces are removed from the carrier.

BRIEF DESCRIPTION OF THE DRAWINGS

There is shown in the attached drawings a presently preferred embodiment of the machine of the present invention wherein.

DESCRIPTION OF PREFERRED EMBODIMENTS

The present invention is a machine for simultaneously finishing two sides of one or more workpieces and a method for utilizing the machine to finish two sides of one or more workpieces simultaneously.

Figure 1:
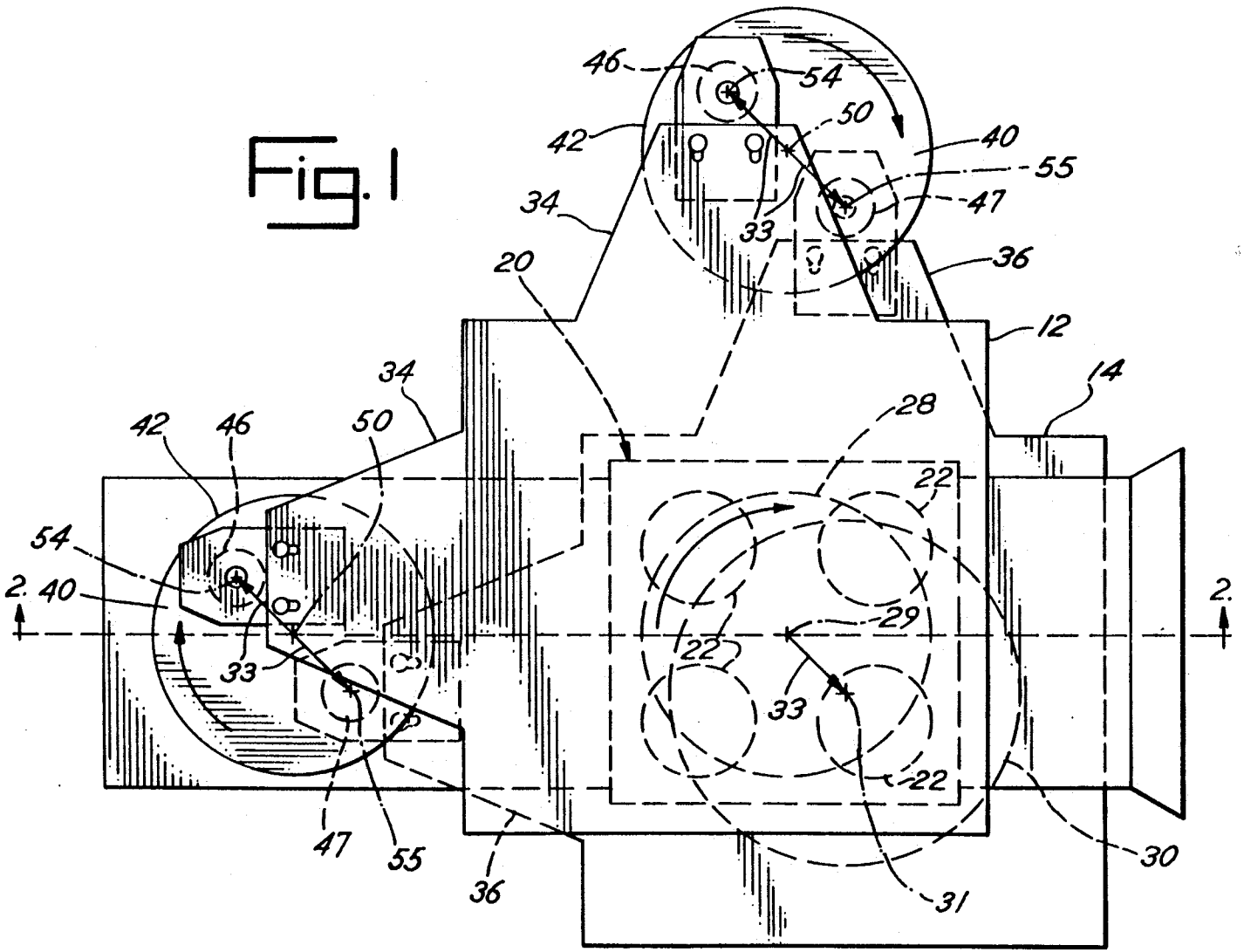
FIG. 1 shows an overhead view of the various elements of the machine of this invention.

The invention is first explained with reference to the figures in which like elements are identified by the same number. FIG. 1 shows an overhead view of various elements of the finishing machine of this invention. The finishing machine has an upper polishing plate assembly 12 and lower polishing plate assembly 14. The upper polishing plate 12 is parallel to the lower polishing plate assembly 14. A carrier 20 containing one or more workpieces 22 is located between the upper polishing plate assembly 12 and the lower polishing plate assembly 14. The carrier 20 has one or more cells in which a workpiece 22 may be placed. Each workpiece 22 is in contact with the upper polishing plate assembly 12 and the lower polishing plate assembly 14 during the workpiece finishing steps. The machine further comprises a spindle 28. A motor causes the spindle 28 to rotate about a first axis 29. A circular spindle cam 30 is attached to spindle 28. The spindle 28 and the circular spindle cam 30 are fixedly attached to one another. A second axis 31 is located at the center of the circular spindle cam 30. There is preferably no relative motion between the spindle 28 and the circular spindle cam 30. They are typically bolted together. As a result, rotation of the spindle 28 about first axis 29 causes the second axis 31 of the circular spindle cam 30 to circumscribe a circle having a radius defining the critical radius.

The upper polishing plate assembly 12 and lower polishing plate assembly are attached by upper polishing plate linkages 34 and lower polishing plate linkages 36 respectively to two eccentric cams 40. Eccentric cams 40 are eccentric due to being off center with respect to spindle 28. Each eccentric cam 40 rotates about a third axis 50. Third axis 50 of each eccentric cam 40 are located 90° apart with respect to first axis 29. Each lower polishing plate linkage 36 is attached to the bottom drive wheel 44 (not depicted) of each eccentric cam 40 at the bottom cam bearing 47. The top drive wheel 42 and bottom drive wheel 44 are attached to an eccentric cam shaft 48 (not depicted). The eccentric cam shaft 48 rotates about a third axis 50. The top cam bearing 46 and bottom cam bearing 47 each rotate about a fourth axis 54 and respectively. The third axis 50 relative to axes 54 and 55 are separated by the critical radius 33.

Figure 2:
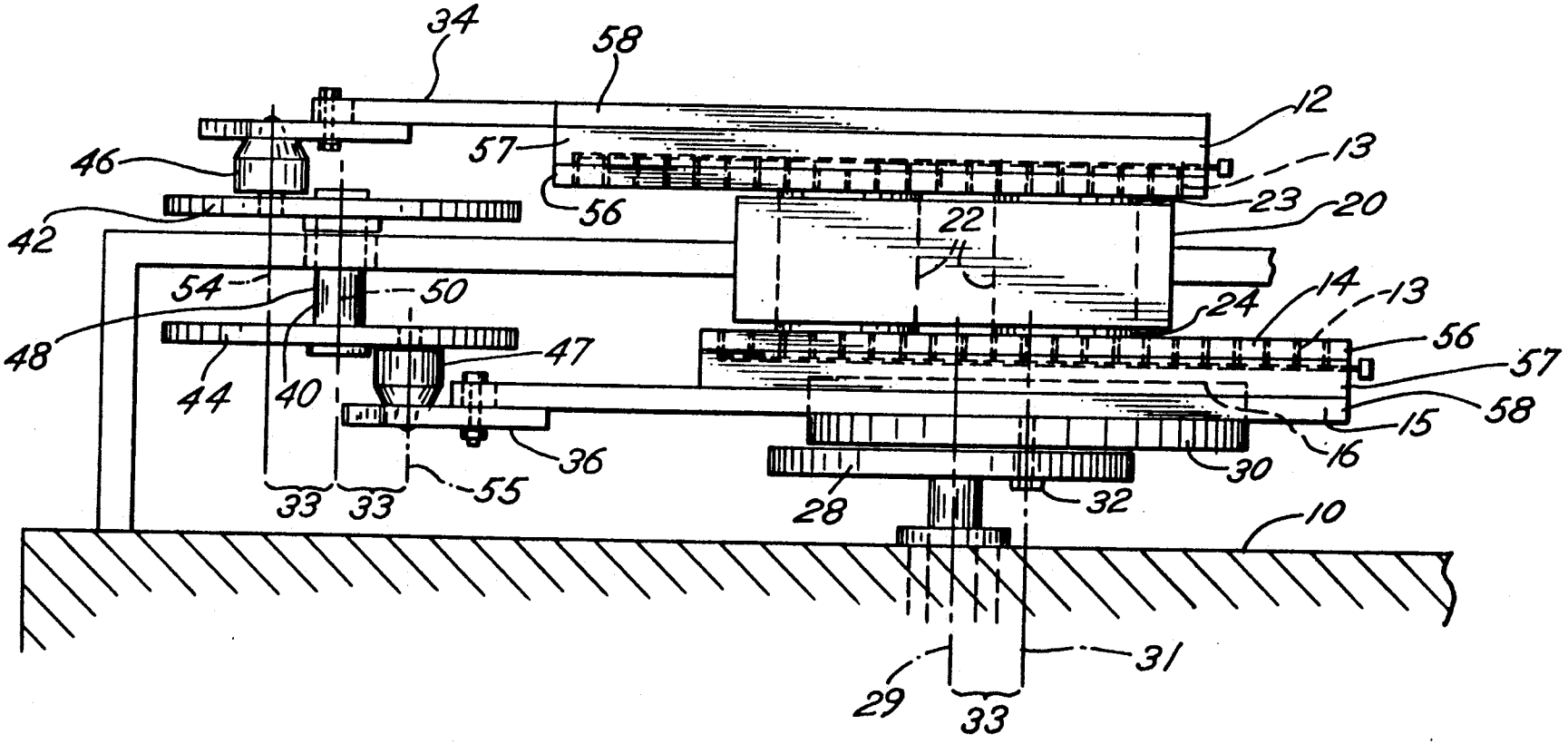
FIG. 2 shows a side view of the various elements of the machine of this invention.

FIG. 2 represents a side view of the machine of this invention. FIG. 2 shows a spindle 28 supported by a base 10. The spindle rotates about a first axis 29 and is attached to a circular spindle cam 30 by attaching means 32. The circular spindle cam is located within a circular depression 16 in the bottom dimension 15 of the lower polishing plate assembly 14. Lower polishing plate assembly 14 and upper polishing plate assembly 12 each contain conduits 13 to provide coolant and/or abrasive to the workpiece 22. Workpiece 22 is held in carrier 20 between the upper polishing plate 12 and the lower polishing plate assembly 14. The carrier 20 may be fixedly, or movably located between the upper polishing plate 12 and lower polishing plate assembly 14. The workpiece 22 has an upper dimension 23 which contacts the upper polishing plate assembly 12 and a lower dimension 24 which contacts the lower polishing plate 14.

The lower polishing plate assembly 14 travels in a circular motion but it does not rotate about an axis, but instead, it circumscribes a circle. The circular motion of the lower polishing plate assembly 14 is transferred through the lower polishing plate linkage 36 to the bottom cam bearing 47 attached to the underside of the bottom drive wheel 44 of eccentric cam 40. The bottom cam bearing 47 is rotatably associated with the lower polishing plate linkage 36. The circular non-rotational motion of the lower polishing plate assembly 14 is transferred to the bottom cam beaning 47 by the lower polishing plate linkage 36 causing the bottom drive wheel 44 in association with the eccentric cam shaft 48 to rotate about the third axis 50. At the same time the eccentric cam 40 is rotating about the third axis 50, the bottom cam bearing 47 is rotating about the fourth axis 54.

At this point, the entire eccentric cam 40 is rotating about the third axis. Therefore, the top drive wheel 42 is also rotating about the third axis. The top drive wheel 42 has a top cam bearing 46 located on the top dimension of the top drive wheel 42. The top cam bearing 46 is rotatably associated with an upper polishing plate linkage 34 which in turn is attached to the upper polishing plate assembly 12. The rotation of the top drive wheel 42 is transmitted via the upper polishing plate linkage 34 to the upper polishing plate assembly 12 causing the upper polishing plate assembly 12 to move in essentially the same circular non-rotational motion as the lower polishing plate assembly 14. However, the top cam bearing 46 and bottom cam bearing 47 are typically in 180° opposition to one another. As a result, the motion of the lower polishing plate assembly 14 in comparison to the upper polishing plate assembly 12 are also typically in 180° opposition to one another. For example, when the upper polishing plate has been drawn by the top cam bearing 46 to its minimum distance from a particular eccentric cam 40, the lower polishing plate which is attached to the bottom cam bearing 47 of the eccentric cam 40 is at its furthest distance from the same eccentric cam 40. The motion of the upper polishing plate assembly 12 and the lower polishing plate assembly 14 does not need to be in 180° opposition. The orientation of the top cam bearings 46 and bottom cam bearings 47 with respect to one another can be adjusted so that the relative motion of the upper polishing plate assembly 12 and lower polishing plate assembly 14 ranges from 0° to about 180° in opposition to one another.

The upper polishing plate 12 contains an upper polishing plate linkage 34 which is united with the top cam bearing 46 of a top drive wheel 42 of each eccentric cam 40. A single upper polishing plate linkage 34 unites a single top drive wheel 42 to the upper polishing plate assembly 12. Likewise, the lower polishing plate 14 is united by separate lower polishing plate linkages 36 to each bottom drive wheel 44 of each eccentric cam 40. The upper polishing plate linkages 34 is rotatably united to the top drive wheel 42 at the top cam bearing 46. The lower polishing plate linkage is rotatably united with the bottom drive wheel 44 at the bottom cam bearing 47. The top drive wheel 42 and bottom drive wheel 44 are parallel to one another and united by eccentric cam shaft 48.

Eccentric cam shaft 48 rotates around third axis 50. The top cam bearing 46 and bottom cam bearing 47 are located at points on the top drive wheel 42 and bottom drive wheel 44 respectively, such that the distance from the third axis 50 to the centers of the top cam bearing 46 and bottom cam bearing 47, the fourth axis 54, is equivalent to the critical radius 33. The top cam bearing 46 and bottom cam bearing 47 may rotate about their centers, fourth axis 54, or they may be fixed such that the circumference of the circle defining the location where the top or bottom cam bearings 46 and 47 are rotatably associated with the upper and lower polishing plate linkages 34 and 36 acts as a bearing surface allowing the top and bottom cam bearings 46 and 47 to pivot about fourth axis 54.

This invention preferably utilizes a pair of eccentric drive cams to simultaneously polish or grind, i.e. finish, both sides of one or more workpieces, such as silicon, metal, glass or other material contained within a carrier. Polishing slurry or grinding coolant can be injected into the work area from both top and bottom polishing plates to enhance the finishing process. Top and bottom polishing (or grinding) plates are attached to the eccentric mechanism through linkages, thus transferring the displacement, velocity and acceleration of the lower polishing plate via the eccentric cam to every point on the upper polishing plate. The use of at least two eccentric cams working in unison to drive a polishing plate enables the upper and lower polishing plates to follow a circular path while maintaining a constant geometric orientation rather than simply rotating about a fixed axis as is common with most polishing equipment.

The major benefit of creating this circular type motion without plate rotation for polishing is that all points on the polishing plate have the same identical displacement, velocity and acceleration at any given instant as the attachment point on the eccentric. Thus, a workpiece held within a carrier between the top and bottom polishing plates will have a uniform relative velocity and acceleration profile across the entire surface of the workpiece which continuously provides uniform stock removal at all points on the workpiece. In addition, the top and bottom plates are rotatably united with eccentric cams at points which are adjustable from 0° to 180° apart. However, when the top and bottom cam bearings of each eccentric cams are 180° apart, their motion relative to each other is 180° out of phase, or in other words, in opposite directions relative to each other. Thus the workpiece is being worked from opposing directions, which would drastically reduce if not cancel the overall resultant forces upon the workpiece. A phase angle of 180° minimizes workpiece rotation within the carrier (for round shaped workpieces) and also reduces forces inflicted upon the carrier from the workpiece. It should be noted that in a machine having more than one eccentric cam the phase angle separating the top and bottom cam bearings for each eccentric cam must be the same.

This machine requires a single motor and spindle located beneath the process area to drive both the bottom and top polishing plates. The main drive spindle is vertically mounted perpendicular to the machine frame or base. A perfectly round spindle cam is fastened to the upper portion of the drive spindle, the center or second axis of which is at one of several possible adjustable distances from the first axis of the spindle cam. The distance between the spindle cam center, the second axis, and the spindle center of rotation, the first axis, defines the critical radius for the eccentric motion, and must be identical on all eccentric mechanisms incorporated within the design. In addition, this critical radius can be made adjustable by incorporating slots and pins into the polishing plate linkages to achieve higher or lower angular velocities, keeping in mind that all eccentries must be adjusted so that they all have equivalent critical radii.

Upper and lower polishing plate assemblies 12 and 14 are preferably comprised of a rigid polish plate 56 made of metal or ceramic, hard plastic block 57 to serve as a bearing material, and a metal backing plate 58. Hard plastic block 57 is preferably made from ultrahigh molecular weight polyethylene, UHMW.

The bottom or lower polishing plate assembly incorporates a hard block 57 which acts as a bearing surface. This block has a circular depression machined into it which allows the circular spindle cam to snugly occupy the depression in the block. This bearing block is sandwiched between the lower polishing plate 56 and an additional metal plate 57 and comprises the lower polishing plate assembly. The additional metal plate on the underside of the plastic block is used for attaching the necessary drive linkages. The upper polishing plate is constructed in a similar manner, however, it does not contain a depression.

A lower polishing plate linkage unites each eccentric cam with the lower polishing plate. Preferably, two lower polishing plate linkages, each attached to a separate eccentric cam, are attached to the lower polishing plate assembly. The two lower polishing plate linkages laterally transfer the eccentric motion of the lower polishing plate to each independent, eccentric cam mechanism. Preferably, the lower polishing plate linkages are perpendicular to one another in relationship to the first axis to facilitate a smooth transfer of motion to and from the eccentric cams. The attachments points on the two eccentric cam mechanisms must be matched to the same critical radius from the center of rotation of the eccentric cam as was set for the main spindle cam. Also note, that if an imaginary arrow were to be drawn from the third axis 50, to the fourth axis 54 or 55, anytime during rotation, both arrows would always point in same direction at any given instant. The distance between the third and fourth axis is equivalent to the critical radius. Therefore, as the lower polishing plate assembly is driven by the spindle cam, the two outside eccentric cams rotate in unison and allow the upper and lower polishing plates to circumscribe a circular path without rotating about any fixed axis.

Motion is transferred to the upper polishing plate assembly via the same two preferred eccentric cams. This is accomplished by utilizing a common eccentric cam shaft perpendicularly uniting a bottom drive wheel and a top drive wheel. When the lower polishing plate in conjunction with the lower polishing plate linkage causes the lower drive wheel of an eccentric cam to rotate, the eccentric cam shaft transfers the rotation to the top drive wheel which, in turn, is linked to the upper polishing plate assembly by an upper polishing plate linkage united with the top drive wheel at a top cam bearing. The rotating cam bearings for both the top and bottom drive wheels of the eccentric cams are again located at the critical radius from the third axis, the critical radius being adjustable for all elements of the machine.

The top and bottom cam bearings are preferably maintained 180° apart to allow the upper and lower polishing plates to remain a constant 180° out of phase. This phase angle can be adjusted as needed, for example, if some workpiece rotation were desired by simply rotating both upper eccentrics clockwise or counterclockwise form a nominal position about their shaft using locking slots or some other means. The phase angle can be adjusted from 0° to 180°.

The upper polishing plate linkage, linking the drive wheel of an eccentric cam to the upper polishing plate, is preferably identical to the lower polishing plate linkage united with the lower polishing plate. The top and bottom cam bearings of an eccentric cam preferably consist of a bearing encased in a round metallic housing the fourth axis of which is located at a distance equivalent to the critical radius from the third axis which is the eccentric cam shaft axis. The entire cam bearing housing can be moved if a critical radius change is desired. Each upper and lower polishing plate linkage perferably has a hole large enough to slip over the bearing housing on the eccentric with minimal clearance. As motion is transferred between the lower and upper polishing plate linkages via the eccentric cam, the cam bearing housing remains in stationary contact with the linkage while the inner race of the cam bearing rotates with the eccentric. This allows for minimal relative movements between metallic surfaces.

The ability of the machine to finish workpieces can be enhanced by applying pressure to the workpieces via one or both of the polishing plates rather than relying upon the dead weight of the system. Preferably, down pressure is applied to the upper polishing plate. Continuous down pressure on the upper polishing plate may be applied using an air cylinder system. The down pressure unit uses one more eccentric mechanisms to provide a down force which is preferably centered at all times over the process area. The process area is defined as the region within the workpiece carrier which is at all times in contact with both the upper and lower polishing plate assemblies. This is the region where one or more workpieces may be located without being exposed due to plate "throw." The process area is directly related to the critical radius of the unit. The smaller the critical radius, the larger is the available process area. The same down pressure cylinder can also be used to move the upper plate assembly on and off of the lower plate for workpiece loading and unloading.

Changes in workpiece size can be accommodated by a carrier change. The carrier material needs to be rigid, yet flexible and is usually at least two-thirds as thick as the workpiece. The critical radius may also be changed to achieve various angular velocities to accommodate workpiece material and size changes. Finally, polishing pads, polishing slurries, grinding media and coolants can be incorporated into the finishing method to facilitate the various grinding and finishing processes required.

Besides the inherent advantage of a uniform velocity profile on all points of the workpiece, the invention lends itself to some other important advantages. One of which is that since the plates do not rotate, polishing slurry or grinding coolant can be pumped using flexible tubing into the process area from both the top and bottom plates without using complex rotary couplings. The same holds true for plate cooling or heating water, or even electrical sensors such as thermocouples or thickness measuring probes. This provides for more complete process control and monitoring then previously possible.

Variations in the structure and formation of the machine of this invention and the method for utilizing the machine of this invention to finish a work pieces will become apparent to those skilled in the art. Any such variations as are within the spirit and scope of this invention are intended to be encompassed within the scope of the claims appended hereto, and are protected by any United States patent issued on this invention.

What I claim is:

1. A machine for simultaneously finishing two sides of one or more workpieces comprising a base, an upper polishing plate, a lower polishing plate, a carrier for holding one or more workpieces, a motor, a spindle having a first axis, a spindle cam having a second axis and two eccentric cams, the carrier located between the upper and lower polishing plates, the motor rotating the spindle about the first axis, the spindle fixedly attached to the spindle cam, the distance from the first axis to the second axis defining a critical radius, each eccentric cam including a bottom drive wheel and a top drive wheel, each bottom drive wheel rotatably united with a lower polishing plate linkage, a lower polishing plate linkage uniting the lower polishing plate with a bottom drive wheel, each top drive wheel is rotatably united with an upper polishing plate linkage, an upper polishing plate linkage uniting the upper polishing plate with a top drive wheel, each eccentric cam rotating about a third axis.

2. The machine of claim 1 further characterized in that the machine has two eccentric cams.

3. The machine of claim 2 further characterized in that the two eccentric cams each are rotatably united with an upper linkage and a lower linkage, the two upper linkages perpendicularly associated with respect to one another, while the two lower linkages are perpendicularly associated with respect to one another.

4. The machine of claim 1 further characterized in that the lower polishing plate has a bottom dimension having a circular depression occupied by the spindle cam.

5. The machine of claim 4 further characterized in that the lower polishing plate assembly includes a bearing surface.

6. The machine of claim 1 further characterized in that the top drive wheel and bottom drive wheel of each eccentric cam have top and bottom cam bearings respectively which rotate about a fourth axis, the top and bottom cam bearings rotatably uniting the upper polishing plate linkage and lower polishing plate linkage with the top drive wheel and bottom drive wheel respectfully.

7. The machine of claim 1 further characterized in that down pressure is applied to the workpieces.

8. A machine for simultaneously finishing two sides of one or more workpieces comprising a base, an upper polishing plate, a lower polishing plate with a bottom dimension having a circular depression, a carrier for holding one or more workpieces, a motor, a spindle having a first axis, a circular spindle cam having a second axis, and two eccentric cams, the carrier fixedly located between the upper and lower polishing plates, the motor rotating the spindle about the first axis, the spindle fixedly attached to the circular spindle cam such that the distance between the first axis and the second axis defines a critical radius, the circular spindle cam occupying the circular depression in the bottom dimension of the lower polishing plate assembly, each eccentric cam including a bottom drive wheel in from 0° to 180° opposition to a top drive wheel, the bottom and top drive wheels united by an eccentric cam shaft perpendicular to the top and bottom drive wheel, each bottom drive wheel rotatably united with a lower polishing plate linkage, a lower polishing plate linkage uniting the lower polishing plate with a bottom drive wheel, each top drive wheel rotatably united with an upper polishing plate linkage, an upper polishing plate linkage uniting the upper polishing plate with an top drive wheel, the eccentric cam shaft of each eccentric cam rotating about a third axis.

9. The machine of claim 8 further characterized in that pressure is applied to the workpieces.

10. The machine of claim 8 further characterized in that each eccentric cam has a top drive wheel with a top cam bearing and bottom drive wheel with a bottom cam bearing the top and bottom cam bearings each rotating about a fourth axis, the top and bottom cam bearings rotatably uniting the upper polishing plate linkage and lower polishing plate linkage with the top drive wheel and bottom drive wheel respectively.

11. The machine of claim 8 further characterized in that the lower polishing plate assembly includes a bearing surface.

12. The machine of claim 8 further characterized in that the upper polishing plate and lower polishing plate include conduits.

13. A machine for simultaneously finishing both sides of one or more workpieces comprising a base, a conduit containing upper polishing plate, a conduit containing lower polishing plate having a bottom dimension with a circular depression, a carrier for holding one or more workpieces, a motor, a spindle having a first axis, a circular spindle cam having a second axis, and two perpendicular eccentric cams, the carrier attached to the base and located between the upper and lower polishing plates, the motor rotating the spindle about the first axis, the spindle fixedly attached to the circular spindle cam such that the first axis and the second axis are offset to define a critical radius, the spindle cam located in the circular depression, each eccentric cam including a bottom drive wheel having a bottom cam bearing and a parallel top drive wheel having a top cam bearing, the top and bottom drive wheels united by an eccentric cam shaft that rotates about a third axis and that is perpendicular to the top and bottom drive wheel, the top and bottom cam bearings of each eccentric cam in 180° opposition, each bottom drive wheel rotatably united with a lower polishing plate linkage by the bottom cam bearing, the lower polishing plate linkage uniting the lower polishing plate with a bottom drive wheel, and each top drive wheel rotatably united with an upper polishing plate linkage by the top cam bearing, the upper polishing plate linkage uniting the upper polishing plate with a top drive wheel, wherein top cam bearing and the bottom cam bearing each rotate about a fourth axis, the third axis separated from the fourth axis of both the top cam bearing and bottom cam bearing by a distance equal to the critical radius.

* * * * *